US008377355B2

(12) United States Patent
Kwon

(10) Patent No.: US 8,377,355 B2
(45) Date of Patent: Feb. 19, 2013

(54) METHOD OF MANUFACTURING ARAMID FILAMENT

(75) Inventor: So-Yeon Kwon, Busan (KR)

(73) Assignee: Kolon Industries, Inc., Kwacheon-Si (KR)

( * ) Notice: Subject to any disclaimer, the term of this patent is extended or adjusted under 35 U.S.C. 154(b) by 921 days.

(21) Appl. No.: 12/440,334

(22) PCT Filed: Sep. 6, 2007

(86) PCT No.: PCT/KR2007/004303

§ 371 (c)(1),
(2), (4) Date: Apr. 17, 2009

(87) PCT Pub. No.: WO2008/030045

PCT Pub. Date: Mar. 13, 2008

(65) Prior Publication Data

US 2010/0196706 A1 Aug. 5, 2010

(30) Foreign Application Priority Data

Sep. 8, 2006 (KR) ..... 10-2006-0086526

(51) Int. Cl.
*D01D 5/06* (2006.01)
*D01F 6/60* (2006.01)

(52) U.S. Cl. ..... 264/184

(58) Field of Classification Search ..... 264/40.1, 264/40.4, 40.7, 184; 528/183, 310
See application file for complete search history.

(56) References Cited

U.S. PATENT DOCUMENTS

| | | | |
|---|---|---|---|
| 4,965,033 | A | 10/1990 | Chiou |
| 5,173,236 | A | 12/1992 | Yang |
| 5,968,432 | A | 10/1999 | Kawai |
| 6,348,263 | B1 | 2/2002 | Hatano et al. |

FOREIGN PATENT DOCUMENTS

| | | | |
|---|---|---|---|
| CN | 1314959 | A | 9/2001 |
| EP | 0021485 | A1 | 1/1981 |
| EP | 1101843 | A1 | 5/2001 |
| EP | 1650251 | A1 | 4/2006 |
| JP | 61-167015 | A | 7/1986 |
| JP | 11-217727 | A | 8/1999 |
| KR | 1020050003123 | A | 1/2005 |
| WO | 9504174 | A1 | 2/1995 |

OTHER PUBLICATIONS

Chinese Office Action issued in corresponding CN Application No. 200780035652.7, dated Oct. 29, 2010.
Rao, et al., "The evolution of structure and properties in poly(ρ-phenylene terephthalamide) fibers," Polymer, 42:13, pp. 5925-5935, Jun. 1, 2001, See EP search report and in English.
European Patent office search report dated Nov. 6, 2009, issued in corresponding application EP Application No. 07808096.7.
Japanese Office Action issued in corresponding Japanese Application No. 2009-527298, dated Apr. 12, 2011.

*Primary Examiner* — Leo B Tentoni
(74) *Attorney, Agent, or Firm* — Sughrue Mion, PLLC

(57) ABSTRACT

Disclosed are a method of manufacturing wholly aromatic polyamid filaments and wholly aromatic polyamid filaments produced by the same. The process includes control of a timing for introducing wholly aromatic polyamid polymer into an extruder for preparation of a spinning dope based on particle size and/or inherent viscosity (IV) of the polyamid polymer.

8 Claims, 2 Drawing Sheets

METHOD OF MANUFACTURING ARAMID FILAMENT

This is a national stage application under 35 U.S.C. §371 of PCT/KR2007/004303 filed on Sep. 6, 2007, which claims priority from Korean patent application KR 10-2006-0086526 filed on Sep. 8, 2006, all of which are incorporated herein by reference.

TECHNICAL FIELD

The present invention relates to a method of manufacturing wholly aromatic polyamide (hereinafter often referred to as "aramid") filaments and aramid filaments manufactured by the same, and more particularly, to a method of manufacturing high strength aramid filaments, characterized in that it can considerably reduce brittleness of polymer due to sulfuric acid used as a solvent when a spinning dope is formed during the filament production process, and the aramid filaments manufactured by the above method.

BACKGROUND ART

As disclosed in conventional documents including U.S. Pat. Nos. 3,869,492 and 3,869,430, wholly aromatic polyamide filaments are usually formed by a method comprising the steps of: preparing wholly aromatic polyamide polymer by polymerizing aromatic diamine and aromatic diacid chloride in a polymerization solvent including N-methyl-2-pyrrolidone; dissolving the prepared polymer in a concentrated sulfuric acid solvent to prepare a spinning solution; forming filaments by passing the spinning solution through a spinning nozzle (40) to obtain a spun material and passing the spun material through a non-coagulative fluid layer into a coagulating solution bath (50); and washing, drying and heat treating the formed filaments.

FIG. 2 is a schematic view illustrating a conventional process for production of wholly aromatic polyamide filaments by a normal dry wet spinning method.

With conventional processes for preparation of a spinning dope, two or more aramid polymers are usually fed into an extruder for preparation of the spinning dope at the same time. Accordingly, the above processes have a requirement that each of the aramid polymers should have a constant particle diameter ranging from 75 to 850 μm and an inherent viscosity (IV) of not less than 5.5 and, more preferably, not less than 6.0.

More particularly, if the aramid polymer has the particle diameter of not more than 75 μm or the inherent viscosity of less than 5.0, the aramid polymer becomes extremely brittle by a sulfuric acid solvent although it is dissolved well in the solvent, thereby leading to significant reduction of strength, especially, side impact strength of aramid filaments in manufacturing the same.

Furthermore, when both of the aramid polymers having relatively larger and smaller particle diameters are simultaneously fed into the extruder for preparation of the spinning dope according to the conventional process, a retention time for each of the aramid polymers in the extruder is extended according as the aramid polymer having the larger particle diameter is completely dissolved in the sulfuric acid solvent. As a result, the aramid polymer having the smaller particle diameter becomes very brittle caused by the sulfuric acid solvent, thereby causing the resultant spinning dope with excessively reduced inherent viscosity (IV) unsuited for manufacturing high strength aramid filaments. In case of introducing the aramid polymers having different IVs into the extruder at once, there is also a problem of extreme brittleness of the polymers by the same reason as described above.

Therefore, the aramid polymers with IVs of not more than 5.0 and/or particle diameters of not more than 75 μm have been used in manufacturing aramid pulp products of low price.

In addition, even if the aramid polymer with IV of 5.0 to 5.5 was adopted, there was only a slight reduction in strength of aramid filaments formed using the aramid polymer.

As described above, the conventionally known processes have the problem in that the aramid polymers having too small or large particle diameters and/or IVs of less than 5.5 cannot be employed in production of aramid filaments, thereby causing increase of production cost thereof.

The present invention has a purpose of solving the above problems and provides a method of manufacturing high strength aramid filaments by using aramid polymers with constant particle diameters and/or IVs out of proper ranges.

DISCLOSURE OF THE INVENTION

Technical Problem

The present invention is directed to use of aramid polymers having constant particle diameters and/or IVs out of the proper ranges known in the prior art for formation of high strength aramid filaments, and an object of the present invention is to provide a method of manufacturing aramid filaments with low production cost.

Another object of the present invention is to provide aramid filaments having excellent strength, especially, excellent side impact strength (hereinafter abbrev. to "the filaments with excellent side impact strength") produced by the above method.

Technical Means to Solve the Problem

In order to accomplish the above objects, the method of manufacturing aramid filaments according to the present invention comprises the steps of dissolving aramid polymer(s) in a sulfuric acid solvent to prepare a spinning dope, spinning the dope through a spinning nozzle to obtain a spun material, passing the spun material through a non-coagulative fluid layer into a coagulating solution bath, and forming the aramid filaments by a series of washing, drying and heat treating processes. The above method is characterized in that a timing of introducing the aramid polymer into an extruder for preparing the spinning dope (hereinafter abbrev. to "extruder") is controlled based on particle size and/or IV of the aramid polymer.

The aramid filaments manufactured in the present invention preferably have side impact strength ranging from 10 to 15 kg·cm/cm when measured according to ASTM-D 1822 method.

Hereinafter, the present invention will be described in detail below with reference to the accompanying drawings.

With regard to the present invention, the timing of introducing the aramid polymer into the extruder can be controlled based on particle size of the aramid polymer. More particularly, the aramid polymer having a larger particle size is first fed into the extruder before pouring the sulfuric acid solvent into the same extruder. On the other hand, the aramid polymer having a smaller particle size is fed into the extruder after first pouring the sulfuric acid solvent into the same extruder.

The inventive method further includes control of the timing for introducing aramid polymer into an extruder based on inherent viscosity (IV) of the aramid polymer.

The inventive method is effective to considerably reduce brittleness of the whole polymer caused by the sulfuric acid solvent, which alters order of introducing the polymer on the basis of fineness (that is, particle size) distribution of the polymer that is necessarily generated during the polymerization process. In the other words, the aramid polymer having the smaller particle size (hereinafter often abbrev. to "polymer") shows brittleness earlier caused by sulfuric acid, compared with the polymer having the larger particle size. Thus, the introduction of the polymer into the extruder must be deferred to reduce extent of the brittleness. On the other hand, the polymer having the larger particle size must be introduced into the extruder before the polymer having the smaller particle size, leading to a complete dissolution thereof in a sulfuric acid solution. Such prepared spinning dope minimizes brittleness of the polymer due to sulfuric acid while maintaining the polymer to be homogeneously dissolved in the sulfuric acid solution, thereby improving strength of filaments as the end product.

In general, brittleness of a spinning dope is mostly generated in the process for preparation of the spinning dope in that the polymer is mixed with the sulfuric acid solvent to dissolve the polymer. This is because it has the highest temperature during preparation of the spinning dope and, at this time, extremely strong shear force is applied thereto. Accordingly, it is considered that principal conditions for manufacturing aramid filaments with excellent side impact strength are completely achieved by minimizing brittleness of the polymer due to sulfuric acid only during preparation of the spinning dope, as described above.

The inventive method is also effective to prepare the spinning dope by using other polymers with different IVs. More particularly, the polymer with low IV has higher solubility in sulfuric acid thus causing serious decrease in physical properties of the filaments. Thus, in order to prevent such decrease in physical properties of the filaments, the introduction order of the polymer into the extruder is preferably deferred. Conversely, for the polymer with high IV, the introduction order of the polymer into the extruder is advanced to markedly reduce brittleness of the whole polymer due to sulfuric acid while maintaining the polymer to be uniformly dissolved in the sulfuric acid solution, leading to a complete preparation of the desired spinning dope.

Commonly, polymers with IVs of not more than 5.0 are unsuitable for production of high strength filaments, and are thus used to produce low price pulp products by any of known pulp manufacturing processes. The filaments formed using the polymers with IVs of 5.0 to 5.5 tend to have a slightly reduced strength. However, the method of the present invention can minimize brittleness of the polymer by altering the introduction order of the polymer into the extruder as described above, even when using the polymers with IVs of 5.0 to 5.5, thereby achieving an economic benefit in that the filaments have strength substantially equal to, that of conventional high strength filaments.

FIG. 1 is a cross-sectional view illustrating an extruder used in an embodiment of apparatuses for preparation of a spinning dope used in the present invention. An arrow of FIG. 1 indicates a direction of transferring a mixture of aramid polymer(s) and a sulfuric acid solvent forward. The polymer having the larger particle size is first fed into an aramid polymer inlet 22 then the sulfuric acid solvent is introduced into a sulfuric acid solvent inlet 23 to sufficiently dissolve the polymer. Alternatively, the other polymer having the smaller particle size is fed into another aramid polymer inlet 24 to prepare and transfer the spinning dope to a further process. Using the above extruder has a result that brittleness of the polymer having the smaller particle size due to the solvent is considerably reduced while completing dissolution thereof and the polymer having the larger particle size is sufficiently dissolved, so that the spinning dope prepared according to the above embodiment of the present invention can exhibit excellent uniformity and minimum brittleness. As a result, the aramid filaments with excellent side impact strength can be obtained using the above spinning dope.

Additionally, the present invention can adopt the polymers with IVs of not more than 5.5 which were not used before in manufacturing the aramid filaments. When the polymer with IV of not less than 5.5 and, preferably, 6.0 or more is first fed into the polymer inlet 22, the sulfuric acid solvent is introduced into the sulfuric acid solvent inlet 23 and the polymer with IV of not more than 5.5 is fed into the other polymer inlet 24 in series, the aramid filaments with high strength, especially excellent side impact strength can be produced.

The aramid polymer with the larger particle size has a particle size ranging from 500 to 1,500 μm, and IV of the aramid polymer with the larger particle size is not less than 5.5 and, more preferably, 6.0 or more.

The aramid polymer with the smaller particle size has a particle size ranging from 60 to 500 μm, and IV of the aramid polymer with the smaller particle size is preferably less than 5.5.

The aramid filaments produced according to the present invention contain the spinning dope with highly controlled IV sufficient to improve hydrogen bonds between molecular chains and a compact structure and have excellent side impact strength as measured by ASTM-D 182 method, which is tensile strength in a direction perpendicular to a fiber axis ranging from 10 to 15 kg·cm/cm, so that the resulting aramid filaments are useful in manufacturing bulletproof products, etc.

The aramid filaments produced by the present invention have an advantage in that molecular chain scission caused by brittleness of the polymer due to sulfuric acid in the process for preparation of the spinning dope is decreased to give a molecular weight: distribution having a larger average molecular weight and a narrow peak, leading to improvements in crystalline orientation, crystallinity, strength, elasticity, side impact strength, creep properties, etc.

Next, the side impact strength will be described in detail below.

A method according to ASTM-D 1822 is described in detail with reference to FIG. 3. At the beginning, an aramid filament sample 100 is mounted on a pendulum head 120 and a serrated jaw 130 of a device for measurement of side impact strength named OLSEN-60 available by Tinius Olsen. After completion of the mounting, the sample is moved in a direction perpendicular to an anvil 160 and the pendulum head and the serrated jaw fall in a circumferential direction. The pendulum head continuously moves in the circumferential direction by the falling force, while the serrated jaw is forcedly stopped in a horizontal direction so that the sample experiences a force corresponding to the side impact strength. Tolerance of the sample against the force is defined as the side impact strength.

Chord modulus of the aramid filament according to the present invention ranges from 550 to 650 g/d and a creep value of the filament ranges from 0.012 to 0.047%/decade, as measured by ASTM D 6992 in a condition of charging 50% load of the maximum strength of the filament to the filament. As the creep value is measured, the creep value for initial 500 seconds is excluded from estimation of a resulting creep value.

Advantageous Effects

As described above, the present invention can use aramid polymers with average molecular diameter and/or inherent viscosity out of proper ranges in manufacturing high strength aramid filaments. Consequently, the present invention has beneficial features to improve production yield of the aramid filaments while reducing production cost thereof.

BRIEF DESCRIPTION OF THE DRAWINGS

The above objects, features and advantages of the present invention will become more apparent to those skilled in the related art in conjunction with the accompanying drawings.

DESCRIPTION OF SYMBOLS FOR MAJOR PARTS IN DRAWINGS

Figure 1:
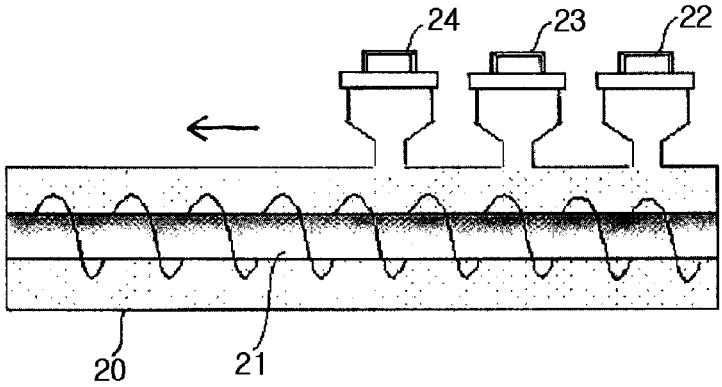
FIG. 1 is a cross sectional view illustrating an extruder for preparation of a spinning dope according to the present invention.

20: extruder for preparation of spinning dope
21: screw
22, 24: aramid polymer inlet
23: sulfuric acid solvent inlet
30: storage tank for spinning solution
40: spinning nozzle
50: coagulating solution bath
60: washing device
70: neutralization device
80: drying device
90: winding machine
110: sample
120: pendulum head
130: serrated jaw
140: spacer
IU 150: crosshead clamp
160: anvil

BEST MODE FOR CARRYING OUT THE INVENTION

Hereinafter, the present invention will be described in detail using the following preferred examples and comparative examples with reference to the above drawings. However, these are intended to illustrate the invention as preferred embodiments of the present invention and do not limit the scope of the present invention.

Example 1

To 1,000 kg of N-methyl-2-pyrrolidone continuously maintained at 80° C., 80 kg of calcium chloride and 48.67 kg of para-phenylenediamine were added and dissolved to prepare an aromatic diamine solution.

Fused terephthaloyl chloride in an equal molar amount as the para-phenylenediamine was fed into a polymerization reactor together with the aromatic diamine solution at the same time, followed by stirring of the mixture to produce poly(para-phenylene terephthalamide) polymer with inherent viscosity (IV) of 6.8.

Next, after the produced polymer was subjected to size separation, a selected polymer with the particle size ranging from 500 to 1,500 μm was first fed into a polymer inlet 22 of an apparatus for preparation of the spinning dope 20, that is, the extruder shown in FIG. 1. Then, 99% concentrated sulfuric acid was introduced into a sulfuric acid solvent inlet 23 and another selected polymer with the particle size ranging from 60 to 500 μm was fed into the other polymer inlet 24 of the same apparatus. The mixture was completely dissolved to prepare an optical anisotropic spinning solution (the dope) containing 18% by weight of the polymer.

Figure 2:
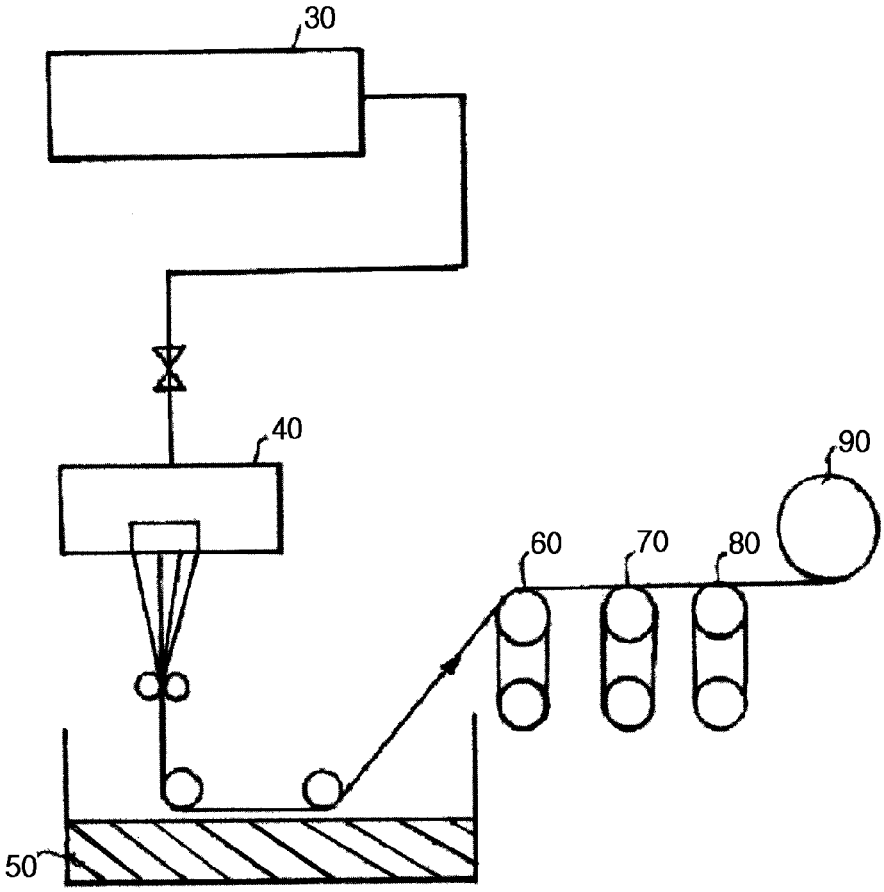
FIG. 2 Prior Art
FIG. 2 is a schematic view illustrating a process for production of aramid filaments by a common dry wet spinning method.
Figure 3:
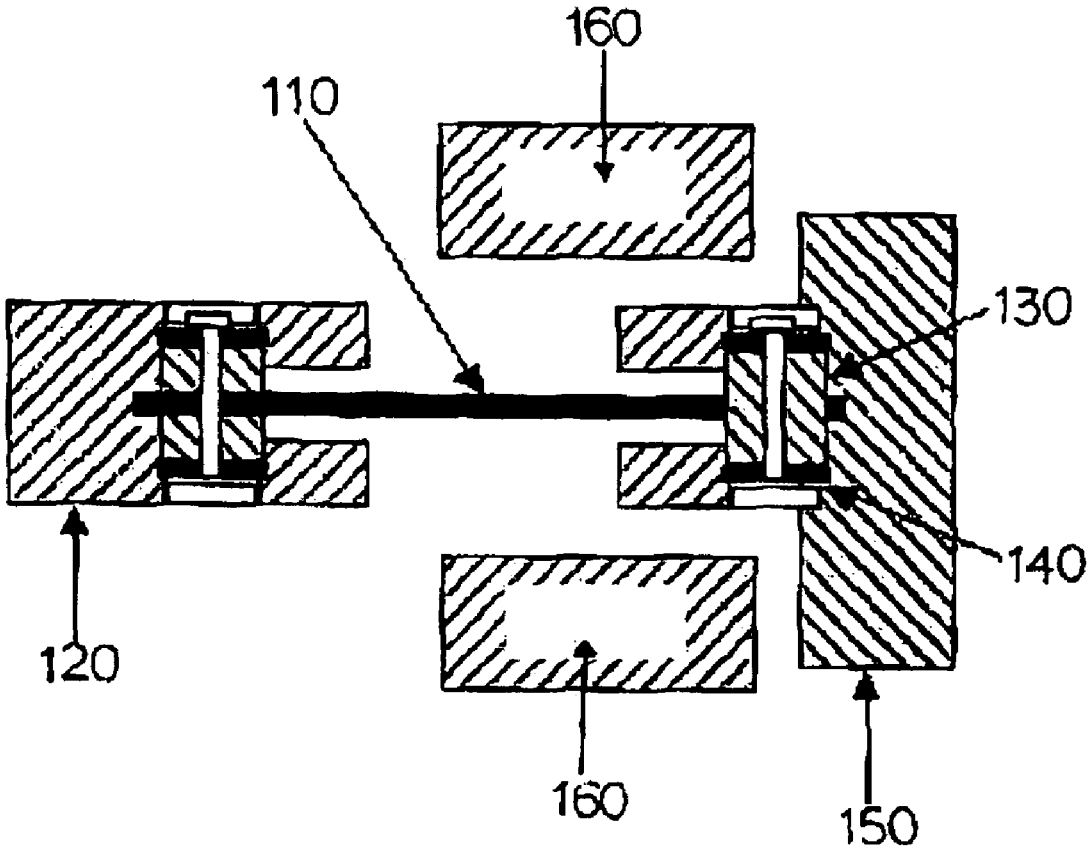
FIG. 3 is a schematic view illustrating a device for measurement of side impact strength of aramid filaments.

After the resulting solution was passed through a spinning nozzle 40 of nozzle block as shown in FIG. 2 to obtain a spun material, the spun material was moved to a place containing water as a coagulating solution through an air layer having 7 mm to form aramid filaments.

The formed aramid filaments were processed into poly (para-phenylene terephthalamide) aramid filaments by a series of treatments including washing and drying. It was found that the resulting aramid filaments have superior side impact strength of 13 to 15 kg·cm/cm.

Example 2

Aramid filaments were produced in the same manner as in Example 1, except that the polymer with IV of 6.0 was used. It was found that the resulting aramid filaments have favorable side impact strength of 11 to 14 kg·cm/cm.

Example 3

Aramid filaments were produced in the same manner as in Example 1, except that the polymer with IV of 5.5 was used. It was found that the resulting aramid filaments have favorable side impact strength of 10 to 12 kg·cm/cm.

Example 4

Aramid filaments were produced in the same manner as in Example 1, except that a polymer with the particle size of 200 to 1,500 μm was fed into the polymer inlet 22 of the apparatus for preparation of the spinning dope 20 and another polymer with the particle size of 60 to 200 μm was fed into the polymer inlet 24 of the same apparatus. It was found that the resulting aramid filaments have favorable side impact strength of 12 to 14 kg·cm/cm and are capable of being used in manufacturing bulletproof products.

Example 5

To 1,000 kg of N-methyl-2-pyrrolidone continuously maintained at 80° C., 80 kg of calcium chloride and 48.67 kg of para-phenylenediamine were added and dissolved to prepare an aromatic diamine solution.

Fused terephthaloyl chloride in an equal molar amount as the para-phenylenediamine was fed into a polymerization reactor together with the aromatic diamine solution at the same time, followed by stirring of the mixture to produce poly(para-phenylene terephthalamide) polymer.

Next, after the produced polymer was subjected to IV selection, a selected polymer with IV of not less than 5.5 was first fed into the polymer inlet 22 of the apparatus for preparation of the spinning dope 20, that is, the extruder shown in FIG. 1. Then, 99% concentrated sulfuric acid was introduced into the sulfuric acid solvent inlet 23 and another selected polymer with IV of less than 5.5 was fed into the other polymer inlet 24 of the same apparatus. The mixture was completely dissolved to prepare an optical anisotropic spinning solution (the dope) containing 18% by weight of the polymer.

After the resulting solution was passed through the spinning nozzle 40 as shown in FIG. 2 to obtain a spun material, the spun material was moved to a place containing water as a coagulating solution through an air layer having 7 mm to form aramid filaments.

The formed aramid filaments were processed into poly (para-phenylene terephthalamide) aramid filaments by a series of treatments including washing and drying. It was found that the resulting aramid filaments have superior side impact strength of 12 to 15 kg·cm/cm.

Comparative Example 1

To 1,000 kg of N-methyl-2-pyrrolidone continuously maintained at 80° C., 80 kg of calcium chloride and 48.67 kg of para-phenylenediamine were added and dissolved to prepare an aromatic diamine solution.

Fused terephthaloyl chloride in an equal molar amount as the para-phenylenediamine was fed into a polymerization reactor together with the aromatic diamine solution at the same time, followed by stirring of the mixture to produce poly(para-phenylene terephthalamide) polymer with IV of 6.8.

Next, after the produced polymer was subjected to size separation, both of a polymer with the particle size ranging from 500 to 1,500 μm and another polymer with the particle size ranging from 60 to 500 μm were fed together into the polymer inlet 22 of the apparatus for preparation of the spinning dope 20, that is, the extruder shown in FIG. 1. Then, 99% concentrated sulfuric acid was introduced into the sulfuric acid solvent inlet 23 and the mixture was completely dissolved to prepare an optical anisotropic spinning solution (the dope) containing 18% by weight of the polymer.

After the resulting solution was passed through the spinning nozzle 40 as shown in FIG. 2 to obtain a spun material, the spun material was moved to a place containing water as a coagulating solution through an air layer having 7 mm to form aramid filaments.

The formed aramid filaments were processed into poly (para-phenylene terephthalamide) aramid filaments by a series of treatments including washing and drying. It was found that the resulting aramid filaments have very low side impact strength of 8 to 9 kg·cm/cm.

Comparative Example 2

To 1,000 kg of N-methyl-2-pyrrolidone continuously maintained at 80° C., 80 kg of calcium chloride and 48.67 kg of para-phenylenediamine were added and dissolved to prepare an aromatic diamine solution.

Fused terephthaloyl chloride in an equal molar amount as the para-phenylenediamine was fed into a polymerization reactor together with the aromatic diamine solution at the same time, followed by stirring of the mixture to produce poly(para-phenylene terephthalamide) polymer.

Next, after the produced polymer was subjected to IV selection, both of a polymer with IV of not less than 5.5 and another polymer with IV of less than 5.5 were fed together into the polymer inlet 22 of the apparatus for preparation of the spinning dope 20, that is, the extruder shown in FIG. 1. Then, 99% concentrated sulfuric acid was introduced into the sulfuric acid solvent inlet 23 and the mixture was completely dissolved to prepare an optical anisotropic spinning solution (the dope) containing 18% by weight of the polymer.

After the resulting solution was passed through the spinning nozzle 40 as shown in FIG. 2 to obtain a spun material, the spun material was moved to a place containing water as a coagulating solution through an air layer having 7 mm to form aramid filaments.

The formed aramid filaments were processed into poly (para-phenylene terephthalamide) aramid filaments by a series of treatments including washing and drying. It was found that the resulting aramid filaments have very low side impact strength of 7 to 9 kg·cm/cm.

INDUSTRIAL APPLICABILITY

As described in detail above, aramid filaments produced by the present invention are preferably applicable to bulletproof clothes such as a bulletproof jacket, optical cable reinforcing materials, etc.

While the present invention has been described with reference to the preferred embodiments, it will be understood by those skilled in the art that various modifications and variations may be made therein without departing from the spirit and scope of the present invention as defined by the appended claims.

What is claimed is:

1. A method of manufacturing aramid filaments, comprising the steps of: dissolving aramid polymer in a sulfuric acid solvent to prepare a spinning dope in an extruder; spinning the dope through a spinning nozzle; passing the spun material through a non-coagulative fluid layer into a coagulating solution bath; and washing, drying and heat treating in series the passed material to form the aramid filaments, wherein the aramid polymer with a particle size of a first range is introduced in the extruder before the aramid polymer with a particle size of a second range is introduced in the extruder, and wherein the particle size of the first range is larger than the particle size of the second range.

2. The method according to claim 1, wherein the aramid polymer with the particle size of the first range is introduced into the extruder before the sulfuric acid solvent is introduced into the extruder, while the aramid polymer with a the particle size of the second range is introduced into the extruder after the sulfuric acid solvent is introduced into the extruder.

3. The method according to claim 1, wherein the particle size of the first range is from 500 to 1,500 μm.

4. The method according to claim 1, wherein the particle size of the second range is from 60 to 500 μm.

5. A method of manufacturing aramid filaments, comprising the steps of: dissolving aramid polymer in a sulfuric acid solvent to prepare a spinning dope in an extruder; spinning the dope through a spinning nozzle; passing the spun material through a non-coagulative fluid layer into a coagulating solution bath; and washing, drying and heat treating in series the passed material to form the aramid filaments, wherein the aramid polymer with inherent viscosity of a first range is introduced in the extruder before the aramid polymer with inherent viscosity of a second range is introduced in the extruder, and wherein the inherent viscosity of the first range is higher than the inherent viscosity of the second range.

6. The method according to claim 5, wherein the aramid polymer with the inherent viscosity of the first range is introduced into the extruder before the sulfuric acid solvent is introduced into the extruder, while the aramid polymer with the inherent viscosity of the second range is introduced into the extruder after the sulfuric acid solvent is introduced into the extruder.

7. The method according to claim 5, wherein the inherent viscosity of the first range is not less than 5.5.

8. The method according to claim 5, wherein the inherent viscosity of the second range is less than 5.5.

* * * * *